US005325161A

United States Patent [19]

Saha et al.

[11] Patent Number: 5,325,161

[45] Date of Patent: Jun. 28, 1994

[54] DEVICE FOR DEVELOPING AN ELECTROSTATIC IMAGE ON AN IMAGE MEMBER

[75] Inventors: Bijay S. Saha; Alec N. Mutz; James R. Flick, all of Rochester; Thomas K. Hilbert, Spencerport, all of N.Y.

[73] Assignee: Eastman Kodak Company, Rochester, N.Y.

[21] Appl. No.: 65,411

[22] Filed: May 24, 1993

[51] Int. Cl.[5] ..... G03G 15/09

[52] U.S. Cl. ..... 355/251; 118/656; 118/657; 355/245

[58] Field of Search ..... 118/656–658; 355/251, 253, 245

[56] References Cited

U.S. PATENT DOCUMENTS

| | | | |
|---|---|---|---|
| 3,176,652 | 4/1965 | Mott et al. . | |
| 4,034,709 | 7/1977 | Fraser et al. | 118/658 |
| 4,286,543 | 9/1981 | Ohnuma et al. | 118/657 |
| 4,295,443 | 10/1981 | Kohyama | 118/657 |
| 4,473,029 | 9/1984 | Fritz et al. | 118/657 |
| 4,531,832 | 7/1985 | Kroll et al. | 355/253 |
| 4,546,060 | 10/1985 | Miskinis et al. | 430/108 |
| 4,602,863 | 7/1986 | Fritz et al. | 118/657 X |
| 4,989,044 | 1/1991 | Nishimura et al. | 355/251 |
| 5,105,226 | 4/1992 | Sugihara | 355/251 |
| 5,164,780 | 11/1992 | Ohno et al. | 355/251 |
| 5,185,496 | 2/1993 | Nishimura et al. | 118/658 |
| 5,189,476 | 2/1993 | Anno et al. | 355/251 X |

FOREIGN PATENT DOCUMENTS

| | | |
|---|---|---|
| 0138261 | 6/1986 | Japan . |
| 0297687 | 11/1989 | Japan . |

*Primary Examiner*—Matthew S. Smith

*Attorney, Agent, or Firm*—Leonard W. Treash, Jr.

[57] ABSTRACT

A magnetic brush device for applying toner to an electrostatic image includes an applicator having a rotatable core. The sleeve for the core is made of an insulating material and preferably has a thin metallic coating on the outside of the sleeve defining the sleeve's outside surface.

11 Claims, 4 Drawing Sheets

DEVICE FOR DEVELOPING AN ELECTROSTATIC IMAGE ON AN IMAGE MEMBER

This invention relates to the development of electrostatic images. More specifically, it relates to an improvement in the construction of a magnetic brush type developing apparatus.

U.S. Pat. No. 4,546,060, Miskinis et al, issued Oct. 8, 1985; U.S. Pat. No. 4,473,029, Fritz et al, issued Sep. 25, 1984; and U.S. Pat. No. 4,531,832, Kroll et al, issued Jul. 30, 1985, all disclose a magnetic brush apparatus in which a rotatable magnetic core is placed in a nonmagnetic aluminum shield or sleeve. The core is rotated rapidly, for example, 500 to 3,000 revolutions per minute, to drive a two component carrier around the sleeve and through a development position with respect to an electrostatic image. The rapidly rotating core causes rapid pole transitions on the surface of the sleeve. The developer includes hard magnetic carrier, that is, a carrier having a high coercivity and permanent magnetism. Such a carrier has a tendency to rapidly flip on the surface of the sleeve in response to the pole transitions. The flipping action of the developer causes it to move around the sleeve in a direction opposite to that of the rotating core. This brush has been found to give extremely high quality development at high development speeds, especially of fine lines and broad solid areas. High speed photographs show that the movement of the developer is in a wave formation as strings of carrier particles lie down and stand up in response to the changing field as they move around the sleeve.

U.S. Pat. No. 5,105,226 to Sugihara, issued Apr. 14, 1992, shows a magnetic brush of a type more commonly used commercially having a stationary magnetic core with a rotating sleeve around the core. The sleeve is rotated fast enough to move either one or two component developer through a development zone. If the developer is of a two component type, the carrier is generally of a soft magnetic material which does not change its position substantially as it rotates through the magnetic fields created as it moves on the sleeve. This brush is generally of an older variety and is not capable of the quality of development provided by the Miskinis et al brush. It is the most common type of brush presently used. In U.S. Pat. No. 5,105,226, the sleeve has an aluminum base with a first layer having an electrical resistance greater than $10^6$ ohms and a second layer formed on the first layer and having an electrical resistance ranging between $10^4$ and $10^9$ ohms. The outside coating can be applied as an antistatic paint.

U.S. Pat. Nos. 4,989,044 and 4,034,709 both show magnetic brushes also of the stationary magnetic core type with an aluminum sleeve in which the aluminum sleeve is covered with a plastic or resin material containing fine conductive particles.

All of the above references have an aluminum sleeve with or without other coatings on it. An aluminum or stainless steel sleeve or shield is conventional in the industry in all types of magnetic brushes.

U.S. Pat. No. 3,176,652 issued to Mont describes a magnetic brush having an elongated magnet stationary in a rotating shield. The shield may be plastic with the outer surface thereof roughened in a random or rectangular pattern to help move the developer.

SUMMARY OF THE INVENTION

Rapid rotation of a magnetic core inside an aluminum sleeve creates the desired rapid pole transitions on the surface of the sleeve for moving a developer having a hard magnetic carrier. However, the conducting nature of the sleeve poses its own handicap. It is basic physics that a time variant magnetic field generates a local electromotive force which, in turn, generates local currents. We feel that this variant magnetic field has created localized heating of the sleeve due to these changing electrical currents it creates in the sleeve. Further, the electrical currents produce their own time variant magnetic fields which are superimposed on the primary field of the core magnets.

It is an object of the invention to improve the performance of prior magnetic brush toning apparatus.

This and other objects are accomplished by a device for applying toner to an electrostatic image on an image member, which device includes a sump for holding a supply dry developer having a magnetic component. The device also includes an applicator which includes a rotatable magnetic core. A sleeve is positioned outside of the core. The sleeve is made of substantially electrically insulating material and has a thin coating of a conductive material on the outside of the insulative material which defines an outside surface of the sleeve. The applicator also includes means for rotating the core to drive the two component developer around the sleeve and through a developing position with respect to the electrostatic image.

According to a preferred embodiment, the sleeve is fabricated from a tough, machinable polymeric material such as material sold under the tradenames of Micarta®, Bakealite® and Textolite® that are available generally from plastic companies. The sleeve is preferably coated using a thin suspension of metallic particles in a polymeric blinder, for example, using a compressed air spray. Excellent results were obtained using a suspension of silver particles in a polymeric blinder having a thickness, when sprayed, of approximately 15 microns.

The rotating core generates substantial heat which, over time, can raise the temperature of the developer mix and cause the developer to clump or otherwise stick to the carrier and interfere with development. In comparing an aluminum, a stainless or another metallic sleeve and a sleeve constructed according to the invention, we found that the rise in temperature of the sleeve itself was substantially lower with the sleeve constructed according to the invention after extended use, for example, one hour. An examination of images toned with the two different types of sleeve indicated also an improvement in the quality of toning. The transition from high density area to the low density areas of the image was much smoother using the insulative sleeve in comparison to the metallic sleeve.

Although the actual mechanism for obtaining these remarkable results is somewhat difficult to prove, we believe the results are due to a reduction in secondary electrical currents in the sleeve by making the conductive portion of the sleeve extremely thin. The purpose of the conductive outer layer is to provide a conductive element for applications of a development field. Ideally, the conductive portion of the sleeve would be as thin as possible without risking its wearing off in use.

SPECIFIC DESCRIPTION OF THE DRAWINGS

DESCRIPTION OF THE PREFERRED EMBODIMENTS

Although this invention may find utility in a magnetic brush development systems, it has particular utility and remarkable results in rotating core systems. An example of such a system is shown in FIG. 1.

Figure 1:
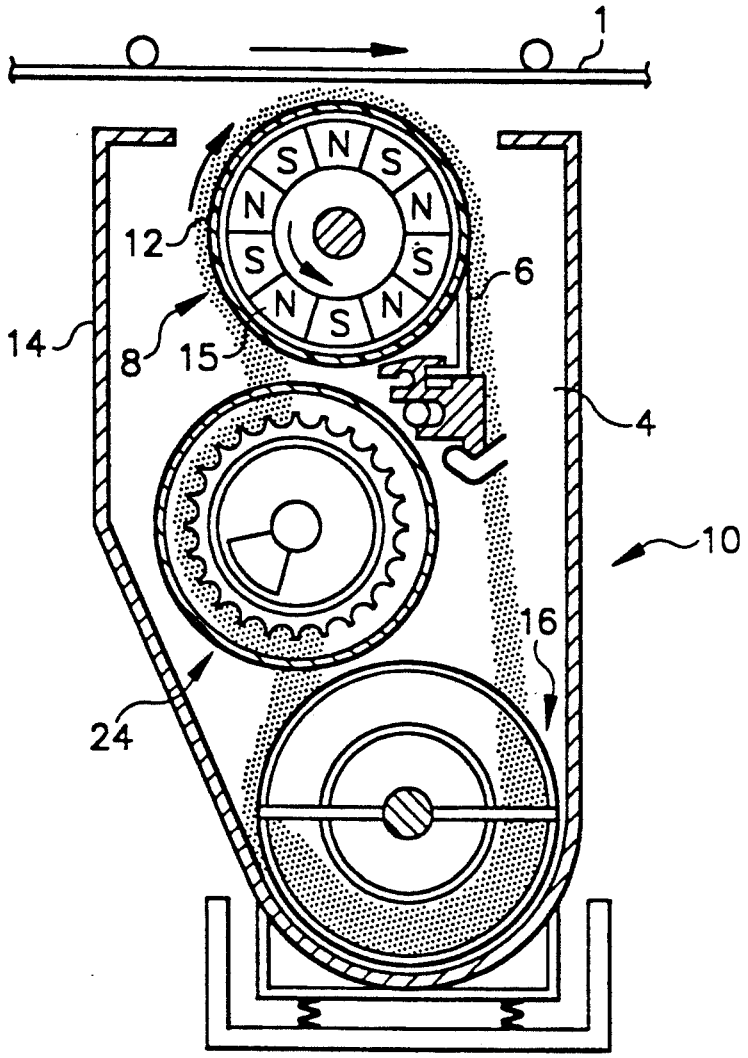
FIG. 1 is a schematic side section of a toning device.
Figure 3:
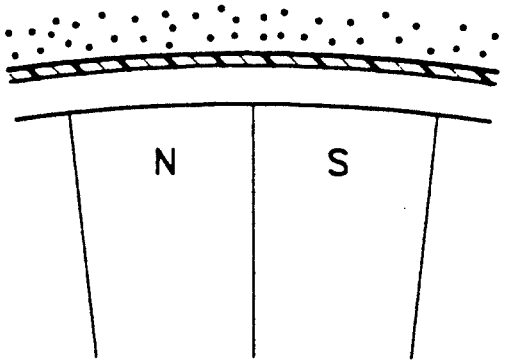
FIG. 3 is a side schematic of a portion of the applicator of FIG. 2.

According to FIG. 1, a toning device or station 10 applies toner to an electrostatic image carried on an image member 1 as the image member 1 moves from left to right, as shown. Station 10 includes a housing 14 which defines a sump 4 for holding a supply of two component developer. Preferably, the two component developer is of a type described in the Miskinis patent, referred to above, which includes hard magnetic carrier particles and insulating toner particles. The developer is mixed in sump 4 by a suitable mixing device, for example, a ribbon blender 16. Developer mixed in sump 4 is picked up by a developer transport 24 and transported to an applicator 8. Applicator 8 includes a rotatable magnetic core 15 surrounded by a sleeve 12 which can also be rotatable or can be stationary. As shown in FIG. 1, core 15 is rotated in a counter-clockwise direction. This causes rapid magnetic pole transitions on the surface of sleeve 12. Because the developer includes a carrier having high coercivity and permanent magnetism, the carrier resists these pole transitions, which, in turn, cause the carrier to flip. This flipping of the carrier causes it to move in a clockwise direction around the sleeve 12. The movement of the carrier can be assisted or resisted by rotation of the sleeve or the sleeve can remain stationary with the entire movement of the developer being supplied by the rotation of the core. As seen better in FIG. 3, the developer actually forms strings or chains of carrier particles which move in a wave formation as the strings lie down and stand up in response to the pole transitions as they move around the sleeve. The movement of the carrier from the sleeve to a position away from the sleeve as the strings or chains of carrier lie down and stand up provides excellent charging to the toner particles and excellent high density, high speed development of electrostatic images. The image member 1 is preferably moved in the same direction and at the same speed as the movement of the developer. This provides a very soft and very high quality development process. For more details of this development process, see the Miskinis et al, Fritz et al and Kroll et al patents referred to above. These patents are all incorporated by reference in this application.

Figure 2:
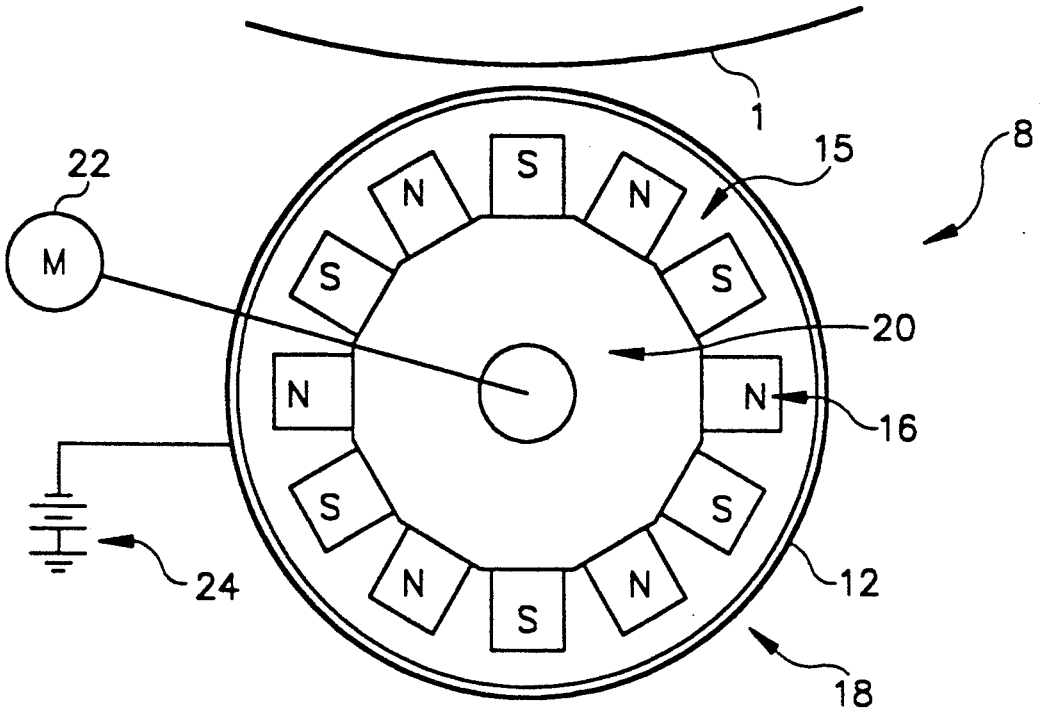
FIG. 2 is a schematic side section of an applicator usable in the toning device shown in FIG. 1.

FIG. 2 shows the applicator in somewhat more detail. Note that in FIG. 2 the core is made up of a core magnet base 20 and a set of 12 magnets 16 with alternating poles. The core base is driven by motor 22 which can rotate the magnetic core 15 at speeds as high as 3,000 revolutions per minute. Image member 1 is shown in FIG. 2 as a drum rather than as the web shown in FIG. 1.

One problem created by the rapidly rotating magnetic core and the rapidly changing magnetic fields that it creates is the rapidly changing electrical currents induced by the magnetic field in the aluminum shell commonly used for sleeve 12. These rapidly changing currents, in turn, are believed to create rapidly changing magnetic fields which have their own individual affect on the movement of the carrier in the developer and appear to affect the formation of the developer strings (shown in FIG. 3) adversely.

Rotation of the magnetic core 15 also in and of itself creates heat. This heat has a tendency to raise the temperature of the sleeve somewhat before it can be dissipated. The additional currents created by the changing magnetic field in this sleeve also appear to create localized heating in the sleeve which contributes to the overall temperature of the sleeve. Excessive localized heating can cause a softening of toner contacting the sleeve which can cause the toner particles to stick together in clumps or to stick to the sleeve or become more attached to the carrier than desirable.

One reason prior sleeves have been made of aluminum is that a conductive sleeve assists in creating an electrical field between the magnetic brush and the image member itself to control development.

According to applicants' invention, improvements in the performance of the brush in several respects can be obtained by making the sleeve of an electrically insulative material. Applicants replace the aluminum sleeve contained in a brush constructed according to the prior art with a sleeve made of an insulative hard plastic. In order to provide the electric field generally desired for development, the sleeve was covered with a very thin layer of a very conductive material, preferably, a metal such as silver. Improved results were seen in both the tendency of the sleeve to overheat and in the actual quality of development of the image.

More specifically, we obtained a fabricated sleeve of two inches nominal outer diameter and 1/16 inch thickness made out of a tough machinable polymeric material similar to that sold commercially under tradenames of Micarta ®, Bakelite ® and Textolite ®. The sleeve was tight fitted with glue on a motor drive similar to a non-magnetic metallic sleeve it was to be compared with. The outer surface of the plastic shell was coated using a suspension of silver particles in a polymeric binder utilizing compressed air spray. The coating thickness was approximately 15 microns. The overall dimension of the brush was kept as identical as possible with the brush made with the metallic sleeve so that ready comparisons can be made. The magnetic trace of the plastic brush was virtually identical to that of the metallic brush. Image quality was evaluated on a linear breadboard under the following operating conditions:

| | |
|---|---|
| Grid Voltage: | 500 volts |
| Auto Bias: | variable in the range of 530–550 volts |
| Charging Velocity: | 1 inch per second |
| Core rpm: | 1,000 |
| Shell rpm: | 0 |
| Offset: | −60 volts |
| Exposure Time: | 2 seconds |
| Development Velocity: | 2–4 inches per second |
| Paper: | laser print paper |
| Toner: | 3.5 micron cyan toner |
| Carrier: | 1.5 parts per 100 + 0.5 parts per |

-continued

| |
|---|
| 100 PMMA coated conductive core |

Figure 4:
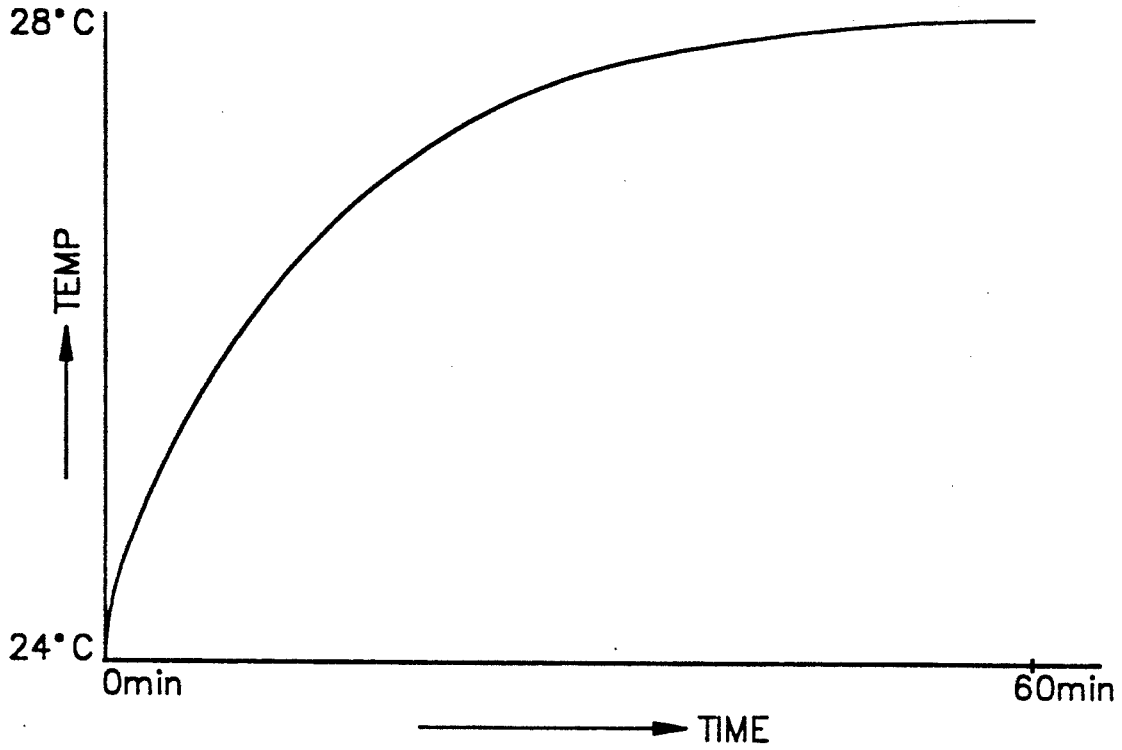
FIGS. 4 and 5 are graphs illustrating rise in temperature on the surface of a development sleeve in two different development devices.
Figure 5:
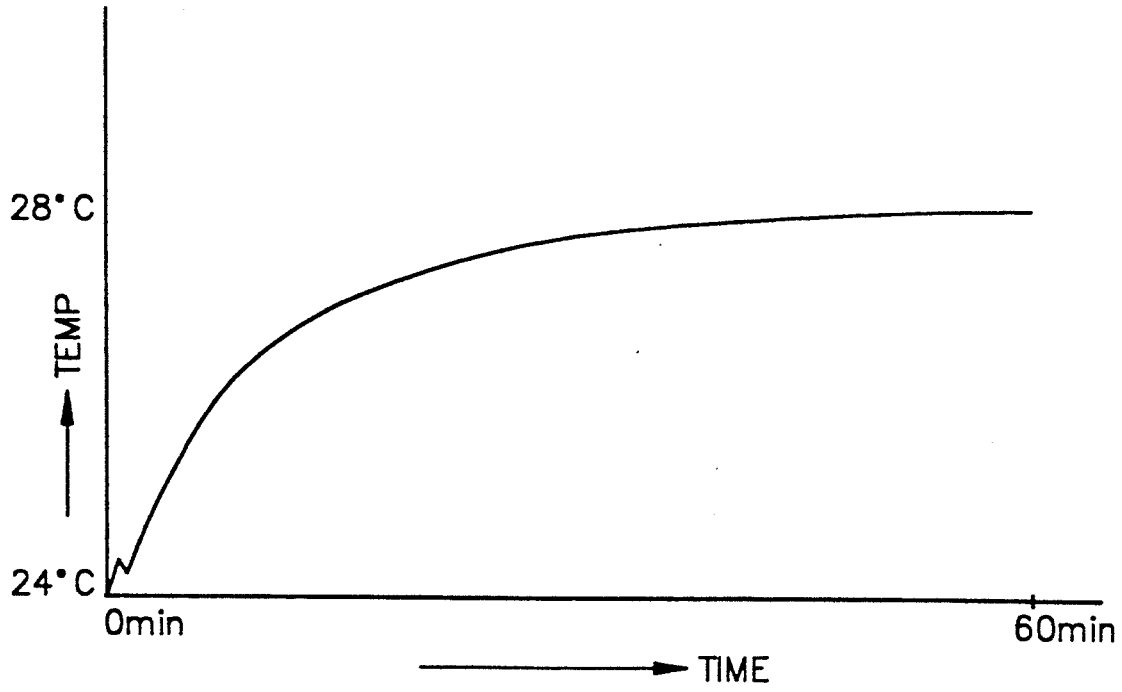

Images were made with the above condition utilizing a magnetic brush having both the metallic and the non-metallic sleeves. A distinct improvement in image quality was observed in the magnetic brush consisting of the insulating sleeve. The transition from high density area to low density areas in the sleeve is much smoother with the insulating sleeve in comparison to the metallic sleeve. Further, as illustrated in FIGS. 4 and 5, the tendency of the sleeve to overheat was greatly lessened. More specifically, FIG. 4 shows a curve of the temperature rise of the sleeve surface against time of use for the metallic sleeve showing a rise in temperature from 24° C. to approximately 39° C. in 60 minutes. FIG. 5 also is a curve of temperature on the surface of the sleeve, but shows a temperature rise of only 4° C. over the same 60 minute time using the plastic sleeve.

The material used for the sleeve can clearly be any insulating material that has mechanical characteristics that allow it to be used. In general, it should be both hard and machinable. It is known in this type of magnetic brush to roughen the surface of the shell. This is preferably done prior to coating it with the metallic coating so that the coating would be of generally uniform thickness. Using a plastic sleeve increase the number of methods that are available for roughening the surface. Preferably, the sleeve should be very insulating, for example, having a resistance of $10^{14}$ or $10^{15}$ ohms. However, improvement, as compared to a metallic sleeve, can be gained at lower resistances, for example, as low as $10^{9}$ ohms.

The thickness of the metallic layer on the outside of the plastic sleeve is also not critical. However, best results are obtained if that thickness is as thin as possible, for example, less than 30 microns thick, while still providing the ability to establish an electric field with it. We found that 15 micron thickness was readily contactable by a brush contact and that the development field was readily established with it. It also did not wear off in extended use. Note that conventionally the bias is a DC bias, but it is also known to have a low frequency relatively high voltage AC component to that bias to assist in development which also can be supplied using the metallic coating.

Figure 6:
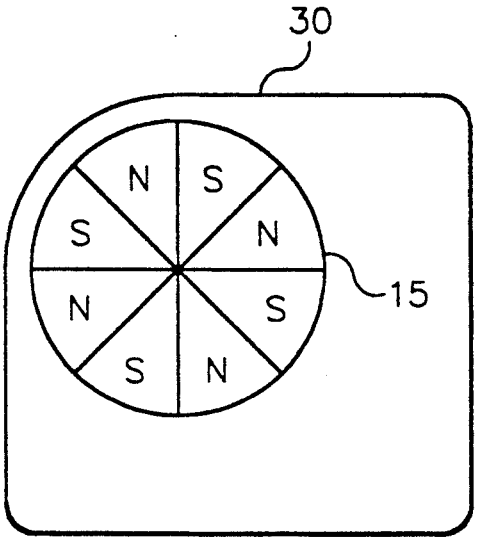
FIG. 6 is a side schematic of another type of applicator in which the invention is usable.

FIG. 6 illustrates a known variation of the magnetic brush shown in FIG. 1 in which the sleeve 30 is stationary and not completely cylindrical. In this instance, the core rotates in a clockwise direction to move developer around the outside of the sleeve in generally a counterclockwise direction through what is a noncylindrical path. Again, in accordance with the invention, the sleeve 30 is made out of an insulative material and can be made in this shape by molding or extruding. The sleeve can then be roughened or serrations made in the extruding process and the metallic coating applied after the serrations have been formed. FIG. 6 also illustrates that it is not necessary for the sleeve to completely surround core 15 but only be within the field of core 15 for the portion of the sleeve over which the developer is moved by rotation of the core.

The invention has been described in detail with particular reference to a preferred embodiment thereof, but it will be understood that variations and modifications can be effected within the spirit and scope of the invention as described hereinabove and as defined in the appended claims.

We claim:

1. A device for applying toner to an electrostatic image on an image member, said device comprising:

a sump for holding a supply of two component, dry developer including hard magnetic carrier particles and insulative toner particles, and an applicator including, a rotatable magnetic core, a sleeve outside of the core, said sleeve being made of a self-supporting base of a substantially electrically insulating material having a thin coating of a conductive material on the outside of the insulative material and defining an outside surface of the sleeve, and means for rotating the core to drive the two component developer around the sleeve and through a developing position with respect to the electrostatic image.

2. A device according to claim 1 wherein the sleeve is cylindrical and extends entirely around the core.

3. A device according to claim 2 wherein the sleeve is also rotatable.

4. A device according to claim 1 wherein the thin coating is less than 30 microns thick and is metallic.

5. A device according to claim 4 wherein the thin coating is silver and has a thickness of about 15 microns.

6. A magnetic brush applicator including:

a rotatable magnetic core, a sleeve outside of the core, the sleeve being made of a substantially electrically insulative material; and, means for rotating the magnetic core with respect to the sleeve.

7. The applicator according to claim 6 wherein said sleeve further includes a thin layer of a conductive material on the outside of the insulative material defining an outside surface of the sleeve.

8. The applicator according to claim 7 further including means for applying an electrical bias to the conductive layer.

9. A sleeve for use with a magnetic brush having a rotating magnetic core around which the sleeve fits, said sleeve including a self-supporting insulative tube coated with a thin conductive layer.

10. The sleeve according to claim 9 wherein said thin conductive layer is less than 30 microns thick and is metallic.

11. The sleeve according to claim 10 wherein the thin conductive layer is silver and is approximately 15 microns thick.

* * * * *